US006880649B2

(12) United States Patent
Edscer

(10) Patent No.: US 6,880,649 B2
(45) Date of Patent: Apr. 19, 2005

(54) APPARATUS AND METHOD FOR DIRECTIONAL DRILLING OF HOLES

(76) Inventor: William George Edscer, Oldlands Farm, Fairland Uckfield, East Sussex TN223BX (GB)

( * ) Notice: Subject to any disclaimer, the term of this patent is extended or adjusted under 35 U.S.C. 154(b) by 0 days.

(21) Appl. No.: 10/866,331

(22) Filed: Jun. 10, 2004

(65) Prior Publication Data

US 2004/0222024 A1 Nov. 11, 2004

Related U.S. Application Data

(62) Division of application No. 10/240,907, filed as application No. PCT/GB01/01735 on Apr. 17, 2001.

(30) Foreign Application Priority Data

Apr. 13, 2000 (GB) ..... 0009008

(51) Int. Cl.[7] ..... E21B 7/08
(52) U.S. Cl. ..... 175/73; 175/90; 175/291
(58) Field of Search ..... 175/45, 73, 89, 175/90, 256, 274, 291, 320

(56) References Cited

U.S. PATENT DOCUMENTS 3,131,778 A 5/1964 Emerson et al.
4,416,339 A 11/1983 Baker et al.
4,582,147 A 4/1986 Dardick
4,884,643 A * 12/1989 Wawrzynowski et al. .... 175/74
4,948,925 A 8/1990 Winters et al.
5,029,653 A 7/1991 Jurgens et al.
5,314,030 A 5/1994 Peterson et al.
5,553,678 A 9/1996 Barr et al.
6,135,215 A * 10/2000 Ericksen ..... 175/61

FOREIGN PATENT DOCUMENTS

GB 1 088 387 10/1967

* cited by examiner

*Primary Examiner*—Zakiya Walker
(74) *Attorney, Agent, or Firm*—Smith-Hill and Bedell

(57) ABSTRACT

An apparatus for the directional drilling of a bore hole through a solid substrate includes a main bore head mounted for rotation on a flexible drive shaft and a pilot bore head for weakening a region of substrate in advance of the main bore head, the weakened region being eccentrically located relative to the main bore head. The apparatus further includes structure for enabling the drilling access of the main bore head, during subsequent drilling of the bore hole, to become substantially aligned with the weakened region of substrate.

2 Claims, 7 Drawing Sheets

APPARATUS AND METHOD FOR DIRECTIONAL DRILLING OF HOLES

CROSS-REFERENCE TO RELATED APPLICATIONS

This is a divisional of co-depending patent application Ser. No. 10/240,907 filed Oct. 4, 2002, which is a 371 of PCT/GB01/01735, filed Apr. 17, 2001.

This invention relates to an apparatus and method of drilling holes in masonry or any other suitable material using a cutting head, or a similar means of excavating the material, where the route of the cutting head can be adjusted during the cutting process to follow a variable path.

Directional drilling tools have been developed in recent years to enable the trenchless installation of underground utility lines.

One such tool is disclosed in U.S. Pat. No. 5,490,569. This apparatus comprises a circular drill bit which is mounted for rotation on a drive shaft. Downstream from the bore head, the drive shaft is housed in an axial hollow formed within a circular casing which extends substantially along the entire axial length of the drilled hole. The radius of the circular casing is nominally equal to or less than that of the cutting circle of the drill bit. A deflection shoe is mounted on the external wall of the casing at a position close to the drill bit. The deflection shoe extends radially outward from the casing and engages with the wall of the drilled hole. At least a portion of the deflection shoe lies outside the cutting circle of the drill bit and, as drilling progresses, the drill bit is deflected in a direction opposing that in which the deflection shoe extends from the casing. Rotation of the casing will cause a change in the direction of deflection of the drill bit. Continuous rotation of the casing will enable to operator to drill straight ahead.

A further directional drilling tool is disclosed in U.S. Pat. No. 5,421,421. This document teaches that as an alternative to employing a permanently mounted deflection shoe, retractable steering plungers may be extended from the casing when a deflection of the drill bit path is desired and retracted to enable the drill bit to proceed in a straight line. The plungers are activated by hydraulic pressure which is supplied from a fluid control means which increases the complexity and cost of the tool.

In accordance with the present invention, there is provided an apparatus for the directional drilling of a bore hole through a solid substrate, the apparatus including:

- a main bore head mounted for rotation on a flexible drive shaft;
- means for weakening a region of substrate in advance of the main bore head, the weakened region being eccentrically located relative to the main bore head; and
- means for enabling the drilling axis of the main bore head, during subsequent drilling of the bore hole, to become substantially aligned with the weakened region of substrate.

Preferably the means for weakening a region of substrate includes a pilot bore head mounted for rotation on a flexible pilot drive shaft passing eccentrically through the main bore head. Preferably means are provided for advancing the pilot bore head from the main bore head to create a pilot bore in the substrate and for retracting the pilot bore head into the main bore head after creation of the pilot bore, the pilot bore defining the weakened region of substrate. The means for enabling the drilling axis of the main bore head to become substantially aligned with the weakened region of substrate preferably comprises means for enabling the drilling axis of the main bore head to become substantially aligned with the axis of the pilot bore drilled by the pilot bore head.

Preferably the main bore head includes a drilling point which defines the drilling axis of the main bore head. Preferably the axis of the pilot bore is axially offset from this drilling point. The axial offset may represent less than about 25% of the diameter of the main bore head. The axial offset may be sufficiently small that the main bore head will, during drilling, find its own way into the pilot bore.

Preferably the drilling point of the main bore head is eccentrically positioned relative to the bore head. The drilling point may be positioned between a quarter and a third of the way along a diameter of the bore head.

Preferably the drilling point and the pilot bore head are positioned within respectively the same half of the main bore head. The drilling point and the pilot bore head may be located generally on the same radius of the main bore head. The pilot bore head is preferably located outwardly of the drilling point of the main bore head.

Rotation of the eccentric bore head may form a bore hole of sufficiently large diameter that the drilling point of the bore head may move into alignment with the bore hole, without the need to drill away any further substrate.

The apparatus may further include means for moving the main bore head, to position its drilling axis substantially on the axis of the pilot bore drilled by the pilot bore head. These means may include means for extending from an outer circumference of the main bore head at a position generally on an opposite side of the main bore head to the drilling point. The extending means may be substantially diametrically opposed to the drilling point. The extending means may include an extensible and retractable cam. The cam may be biased into its extended position. The cam may be mounted such that, when the main bore head is rotated in a drilling direction, the cam is urged against the force of the biasing means into its retracted position. The cam may be mounted such that, when the bore head is rotated in an opposite direction, the cam is urged by the biasing means against an inner surface of the main bore hole, to push the main bore head away from that surface.

Preferably the pilot bore head is mounted within the main bore head such that relative rotation therebetween may be selectively allowed or prevented. Means may be provided for allowing such relative rotation when the pilot bore head is in its advanced position and preventing such relative rotation when the pilot bore head is in its retracted position. The means for preventing relative rotation may include a plurality of locking splines.

The axis of the pilot bore head may be substantially parallel to the axis of the main bore head. Alternatively the axis of the pilot bore head may be angled at up to about 45° from the axis of the main bore head.

In accordance with the present invention, there is further provided an apparatus for the directional drilling of a bore hole through a solid substrate, the apparatus including:

- a main bore head rotatably mounted on a flexible main drive shaft;
- a pilot bore head rotatably mounted on a flexible pilot drive shaft passing eccentrically through the main bore head;
- means for advancing the pilot bore head from the main bore head to create a pilot bore in the substrate;
- means for retracting the pilot bore head into the main bore head after creation of the pilot bore; and
- means for allowing the drilling axis of the main bore head, during subsequent drilling of the bore hole, to become substantially aligned with the axis of the pilot bore drilled by the pilot bore head.

In accordance with a further aspect of the present invention, there is provided an apparatus for the directional drilling of a bore hole through a solid substrate, the apparatus including:

a main bore head rotatably mounted on a flexible main drive shaft;

a pilot bore head rotatably mounted on a flexible pilot drive shaft passing eccentrically through the main bore head;

means for advancing the pilot bore head from the main bore head to create a pilot bore in the substrate; and means for rotating the main bore head, with the pilot bore head located in the pilot bore, to laterally alter the position of the main bore head within the substrate.

According to a further aspect of the present invention there is provided an apparatus for the directional drilling of a bore hole through a solid substrate, the apparatus including:

a main bore head mounted for rotation on a flexible main drive shaft; and an extensible and retractable cam, the cam being biased into its extended position and mounted such that, when the main bore head is rotated in a drilling direction, the cam is urged against the force of the biasing means into its retracted position and when the bore head is rotated in an opposite direction, the cam is urged by the biasing means against an inner surface of the main bore hole, to push the main bore head away from that surface.

In accordance with a further aspect of the present invention, there is provided an apparatus for the directional drilling of a bore hole through a solid substrate, the apparatus including:

a main bore head mounted for rotation on a flexible main drive shaft; and elongate tensioning means extending axially along the flexible drive shaft substantially from the main bore head end of the drive shaft towards a driven end of the drive shaft, wherein tension in the tensioning means tends to urge the flexible drive shaft to bend, thereby altering the drilling direction.

Preferably the elongate tensioning means is anchored at a position remote from the main bore head, extends towards the main bore head, passing freely through a locating means, and then extends towards the driven end of the drive shaft.

Preferably the elongate tensioning means comprises a wire.

According to the invention, there is further provided apparatus for the directional drilling of a bore hole through a solid substrate, the apparatus including:

a main bore head;

a pilot bore head mounted for rotation on a flexible shaft; and means for exerting a force on the main bore head when it is located in a bore hole, to urge the bore head towards one side of the bore hole.

The main bore head and the pilot bore head may be mounted on respectively the same shaft or on different shafts.

The biasing means may include an extensible and retractable cam. The cam may be located on the main bore head. Alternatively the cam may be located on the main drive shaft. Preferably the cam is biased into the retracted position. The cam may be extended or retracted by applying tension to a cable connected to the cam and extending to a non-drilling region of the drilling apparatus.

The apparatus may further include one or more additional bore heads, between the main bore head and the pilot bore head in size.

The apparatus may further include means for conveying a lubricant, for example water to the or each bore head, for lubricating the drilling process.

The pilot shaft and the main bore shaft may be in threaded engagement with one another.

According to the invention there is further provided a method for the directional drilling of a bore hole through a solid substrate, the method including the steps of:

drilling a main bore hole using a main bore head;

weakening a region of substrate in advance of the main bore head, the weakened region being eccentrically located relative to the main bore head; and drilling further with the main bore head, allowing the axis of the main bore head to become aligned with the weakened region in the substrate.

According to the invention there is further provided a method for the directional drilling of a bore hole through a solid substrate, the method including the steps of:

drilling a main bore hole using a main bore head;

drilling a pilot bore hole in the substrate at an end of the main bore hole, the pilot bore hole having an axis offset from a drilling axis of the main bore head; and drilling further with the main bore head, allowing the axis of the main bore head to become aligned with the axis of the pilot bore hole such that the main bore hole follows the path of the pilot bore hole.

The drilling of the pilot bore hole may weaken the substrate at the end of the main bore hole, in a region between the pilot bore hole and the drilling axis of the main bore head.

The method may include the step of moving the main bore head into alignment with the pilot bore hole, before or during the further drilling with the main bore head.

Embodiments of the invention will be described for the purpose of illustration only with reference to the accompanying drawings, in which.

Figure 1:
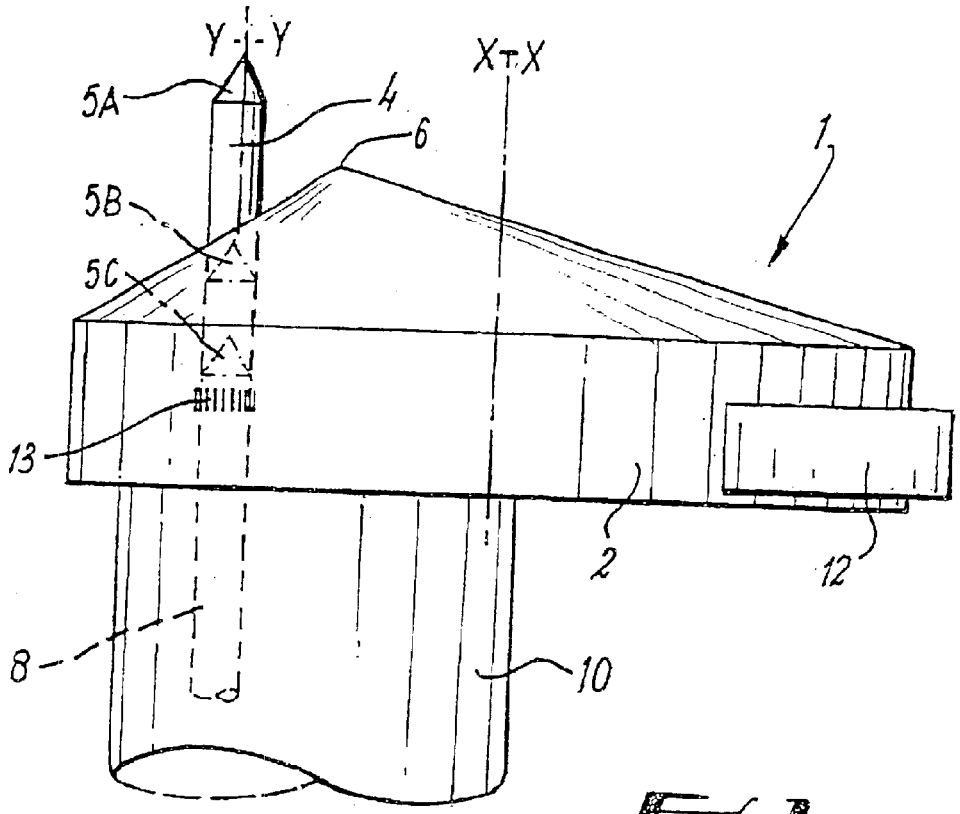
FIG. 1 is a schematic cross-sectional view of a drilling tool in accordance with a first embodiment of the present invention.

As shown in FIG. 1, directional drilling apparatus in the form of a drilling tool 1 includes a main drilling bore head 2 and a pilot drilling bore head 4. The main drilling bore head 2 has a drilling point 6 which is displaced laterally from the centre axis XX of the main drilling bore head 2. A pressure cam 12 is mounted on the side of the main drilling bore head 2 and is positioned to act at the furthest point from the drilling point 6.

The pilot drilling bore head 4 has a pilot drilling axis YY and is receivable within a hole in the main drilling bore head 2 such that the pilot drilling axis YY is displaced laterally from both the centre axis XX of the main drilling bore head 2 and the drilling point 6. The pilot drilling bore head 4 is retractable through the main drilling bore head 2 and is shown in an extended position 5A, and ghosted a first retracted position 5B and a second retracted position 5C.

The pilot drilling bore head 4 is mounted on a flexible drive shaft 8 which passes through the hole in the main drilling bore head 2. The flexible drive shaft 8 is contained within another flexible drive shaft 10 which is used to drive the main drilling bore head 2.

The pilot drilling bore head 4 includes locking splines 13 which are used to lock the pilot drilling bore head 4 to the main drilling bore head 2 when the pilot drilling bore head 4 is in the second retracted position 5C. The locking splines 13 are disengaged when the pilot drilling bore head 4 is extended to the first retracted position 5B allowing the pilot drilling bore head 4 to be driven by the flexible drive shaft 8 in this position.

Figure 2:
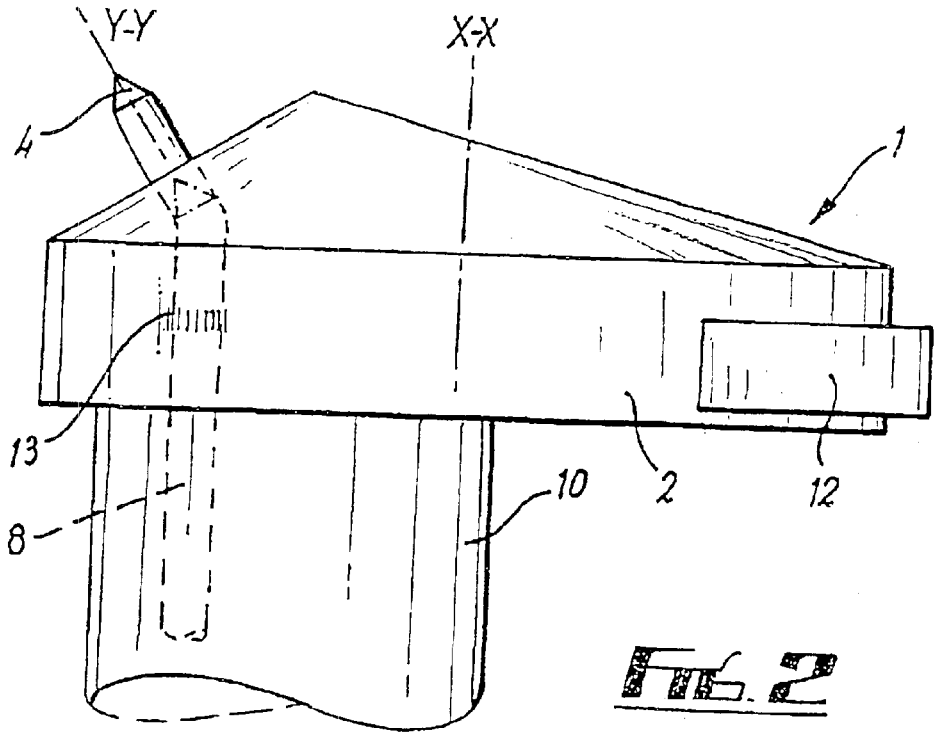
FIG. 2 is a schematic cross-sectional view of a drilling tool in accordance with a second embodiment of the present invention.
Figure 7:
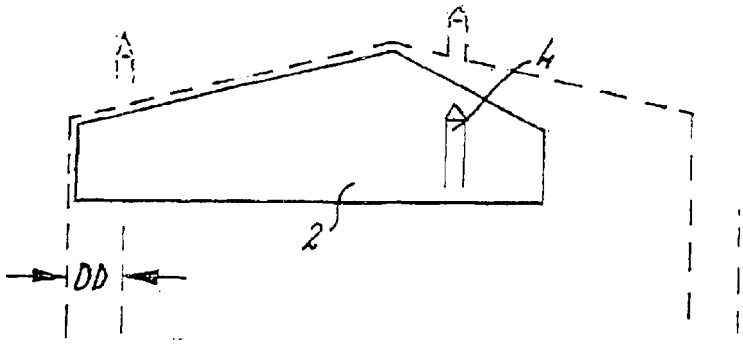
FIG. 7 is a schematic view of the drilling tool of FIG. 1 at a fifth instant in time.
Figure 6:
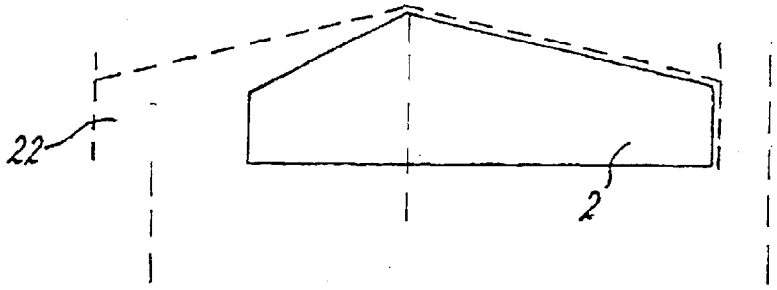
FIG. 6 is a schematic view of the drilling tool of FIG. 1 at a fourth instant in time.
Figure 5:
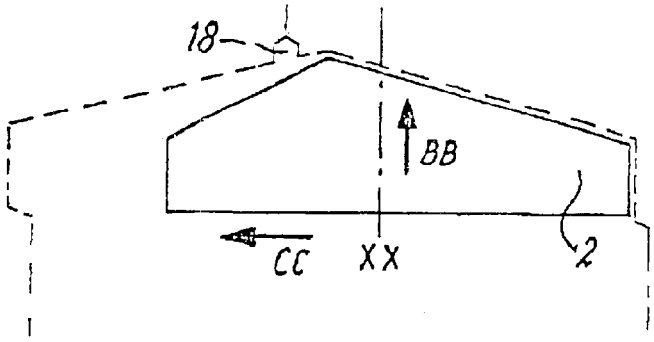
FIG. 5 is a schematic view of the drilling tool of FIG. 1 at a third instant in time.
Figure 4:
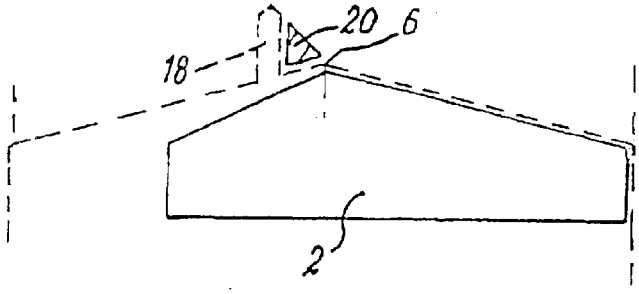
FIG. 4 is a schematic view of the drilling tool of FIG. 1 at a second instant in time.
Figure 3:
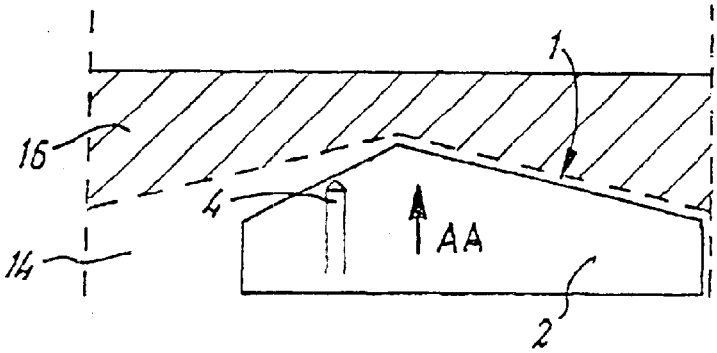
FIG. 3 is a schematic view of the drilling tool of FIG. 1 at a first instant in time.

The pilot drilling axis YY of the pilot drilling bore head 4 does not necessarily have to be parallel with the centre axis XX of the main drilling bore head 2 but may instead be positioned at a fixed angle to the centre axis XX of the main drilling bore head 2 as shown in FIG. 2.

The operation of the drilling tool 1 as shown in FIG. 1 is now explained with reference to FIGS. 3 to 7. The drilling tool 1 is shown within a main bore 14 which is wider than the main drilling bore head 2. As explained later in more detail this is because the drilling point 6 of the main drilling bore head 2 is laterally displaced from the centre axis XX of the main drilling bore head 2.

Initially, the pilot drilling bore head 4 is angularly positioned by rotating the main drilling bore head 2. The pilot drilling bore head 4 is then extended as shown by the arrow AA until the locking splines 13 of FIG. 1 are disengaged and the pilot drilling bore head 4 is no longer secured to the main drilling bore head 2. The pilot drilling bore head 2 is then rotatably driven by the flexible drive shaft 8 of FIG. 1 and is advanced into a section of the masonry 16.

Once the pilot drilling bore head 4 has been advanced a predetermined distance the pilot drilling bore head 4 is retracted into the main drilling bore head 2 until the locking splines 13 of FIG. 1 secure the pilot drilling bore head 4 to the main drilling bore head 2. The pilot drilling bore head 4 leaves behind a pilot bore 18 having a diameter the same as that of the pilot drilling bore head 4. The drilling of the pilot bore 18 creates an area of weakened masonry 20 between the pilot bore 18 and the drilling point 6 of the main drilling bore head 2.

Once the pilot drilling bore head 4 is secured to the main drilling bore head 2 the main drilling bore head 2 is then rotatably driven by the flexible drive shaft 10 of FIG. 1 and is advanced as shown by the arrow BB. The weakened area of masonry 20 is easier to drill than the surrounding masonry and as the main drilling bore head 2 is advanced it moves toward the pilot bore 18 as shown by the arrow CC.

During drilling, the drilling point 6 of the main drilling bore head 2 acts as a rotation axis around which the main drilling bore head 2 rotates. Because the drilling point 6 (and hence the rotation axis) of the main drilling bore head 2 is laterally displaced from the centre axis XX of the main drilling bore head 2 the main drilling bore head 2 rotates eccentrically about the drilling point 6 and the resulting main bore 14 has a diameter larger than that of the main drilling bore head 2.

Once the drilling point 6 of the main drilling bore head 2 is positioned within the pilot bore 18 drilling continues, centred on the pilot bore 18, until the main drilling bore head 2 has advanced a predetermined distance. The new main bore 22 is laterally displaced from the previous main bore 14 by a distance DD as shown.

Finally, the pilot drilling bore head 4 is angularly re-positioned by rotating the main drilling bore head 2 and the drilling sequence begins again. In this way the main drilling bore head 2 and the resulting main bore is laterally "stepped" through the masonry.

If the pilot drilling axis YY is not parallel to the centre axis XX of the main drilling bore head 2 illustrated in FIG. 2 then the resulting pilot hole will angle the main drilling axis of the main drilling bore head 2 as it advances with the drilling point 6 centred on the pilot hole. In this way the main drilling bore head 2 and the resulting main bore can be made to follow a smooth curved route instead of the "stepped" route described above.

Figure 8:
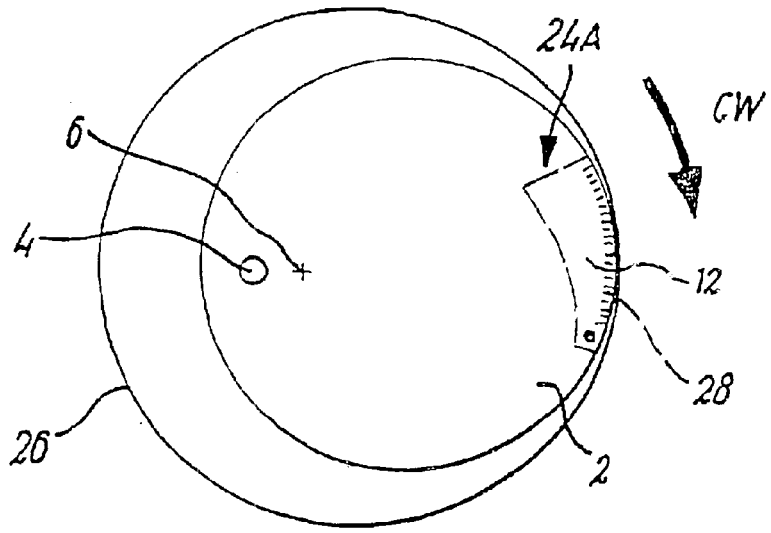
FIG. 8 is a schematic end view of the drilling tool of FIG. 1 with a pressure cam in a retracted position.
Figure 9:
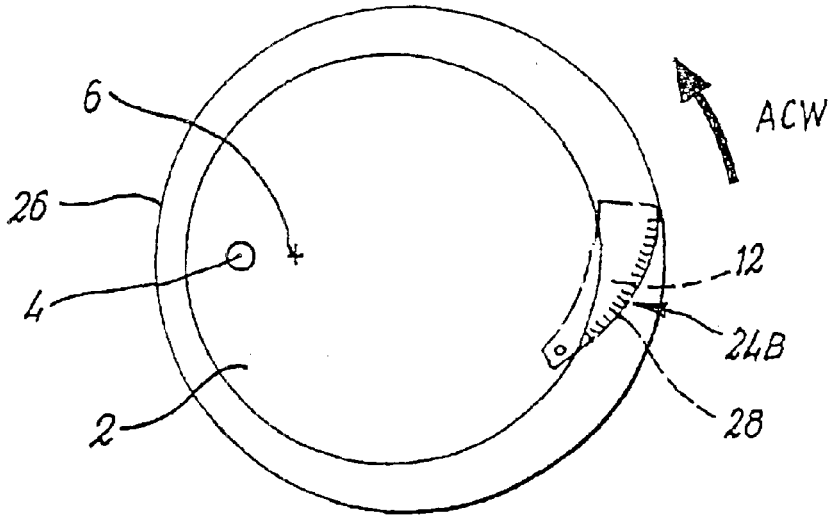
FIG. 9 is a schematic end view of the drilling tool of FIG. 1 with the pressure cam in an extended position.

The pressure cam 12 may also be used if the main bore is to follow a continuous curved path or if other adjustments are necessary which cannot be accomplished by using either of the methods described above. The operation of the pressure cam 12 is now explained with reference to FIGS. 8 and 9.

The pressure cam 12 is mounted on the side of the main drilling bore head 2 and is receivable within the main drilling bore head 2 when in a retracted position 24A. The pressure cam 12 includes a cam tensioning spring 28 which acts to keep the pressure cam 12 in an extended position 24B. The pressure cam 12 is positioned to be at the furthest point from the drilling point 6 of the main drilling bore head 2 around which the main drilling bore head 2 rotates during operation. This means that the pressure cam 12 is in contact with the inner surface of the main bore 26 at all times. When the main drilling bore head 2 is stationary or rotating in a cutting direction CW the saw-tooth shape of the pressure cam 12 means that it is kept in the retracted position 24A by the inner surface of the main bore 26.

Activation and deactivation of the pressure cam is achieved by reversing the direction of rotation of the main drilling bore head 2. When the main drilling bore head 2 is rotated in a direction opposite to the cutting direction ACW then the friction between the pressure cam 12 and the inner surface of the main bore 26 due to the saw-tooth shape of the pressure cam 12, and the additional force exerted by the cam tensioning spring 24, means that the pressure cam 12 is activated and pivots outwards. The pressure cam 12 exerts a radial force on the inner surface of the main bore 26 and causes the main drilling bore head 2 to move away from that side of the main bore 26. Further changes in direction may be made by alternately activating and deactivating the pressure cam 12 to steer the main drilling bore head 2.

The drilling tool 1 may be used in, for example, the reinforcement of curved structures such as arched bridges. An operator may use the drilling tool 1 to drill a curved or stepped hole generally in line with the shape of the bridge. Marks in the form of lines extending along the drive shaft to its driven end may indicate the circumferential positions of the pilot bore and the cam, to enable the operator to adjust the path of the drilling tool as required.

The path of the drilling tool may be monitored by drilling small pilot holes into the structure, substantially transverse to the drilling direction.

Once a suitable main bore hole has been drilled, a reinforcement bar may be inserted. The reinforcement is preferably of metal but is of a sufficiently narrow diameter that it may bend to follow the path of the curved hole. The bar may be grouted into place by injecting grout from the base of the hole. When grout starts to flow out of the first pilot hole, this indicates that the main ore hole is filled with grout at least to the point where it meets that pilot hole. The end of that pilot hole is then sealed and the injection of grout continued until it starts to flow out of the next pilot hole. This process is continued until all the pilot holes, and also thus the full length of the main bore hole, are full of grout.

There is thus provided a drilling tool and method of drilling which may be used to drill stepped, angled or generally curved bores in masonry. The operation of the tool is relatively straightforward in comparison with prior art methods. The tool is particularly useful for the reinforcement of bridges in accordance with the Applicant's European Patent No. 2302896.

Various modifications may be made to the above described embodiment without departing from the scope of the invention. The dimensions of the apparatus will of course depend upon its application. The flexible drive shaft is likely to be between 15 mm and 100 mm in diameter, with the diameter of the main drilling bore head being in a similar range but typically about twice the diameter of the drive shaft. The diameter of the pilot shaft is likely to be between 5 mm and 20 mm.

A pilot bore need not be used for weakening the substrate. Other means for weakening the substrate might include, for example, directing a jet of water at the region of substrate to be weakened.

Instead of allowing main bore head to locate itself in alignment with the weakened region or the pilot bore hole, the pilot bore may be left within the pilot bore hole and the main bore head rotated with the pilot bore in place. This forces the main bore head to shift its axis towards that of the pilot bore.

Alternatively, the cam alone may be used to shift the axis of the main bore head. Where the substrate is relatively weak, there may not be any need to use the pilot bore.

Instead of being located on the main bore head, the cam may be located on the drive shaft, near the main bore head. Cams could be provided both on the main bore head and on the drive shaft.

Figure 10:
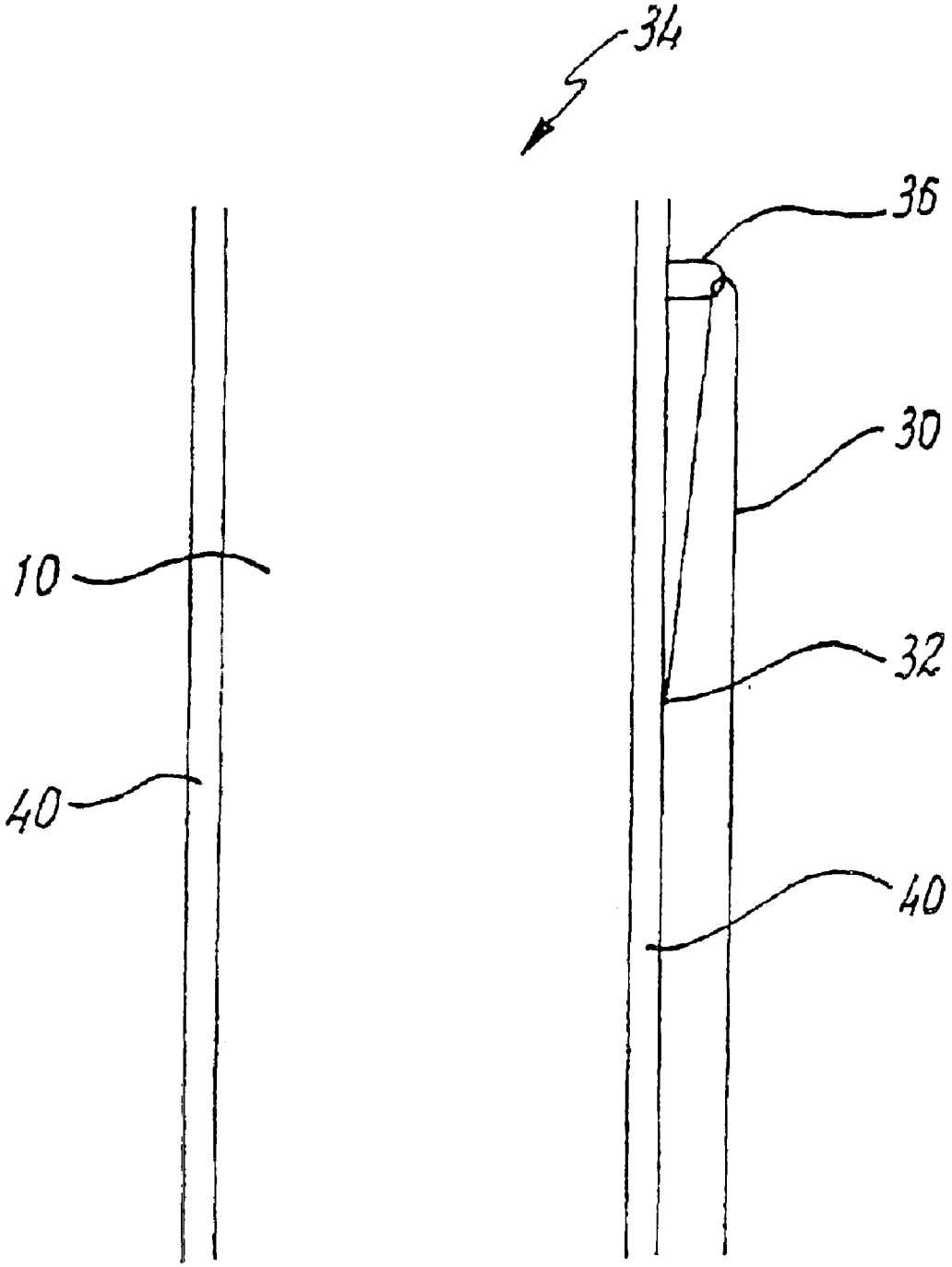
FIG. 10 is a partial schematic side view of a drilling tool in accordance with a third embodiment of the present invention.

Alternatively, the direction of drilling may be controlled as illustrated in FIG. 10. According to this embodiment of the invention, the flexible drive shaft 10 is provided with a tension wire 30 for adjusting the drilling direction. The tension wire 30 is attached to the drive shaft 10 at a point 32 spaced from the drilling end 34 of the drive shaft 10. The tension wire 30 then extends towards the drilling end 34 of the drive shaft and passes freely through a guide 36, doubling back on itself to extend to the drive end of the drive shaft 10. The wire 30 passes through further guides (not illustrated) to ensure that it does not move around the circumference of the drive shaft.

In the above embodiment, the tension wire 30 may be pulled to adjust the orientation of the drive shaft. The wire 30 may be provided on an outer sleeve 40 which is freely rotatable relative to the drive shaft 10. The outer sleeve 40 may be rotated to a desired orientation and the wire 30 pulled to bend the drive shaft in a particular direction during drilling.

In any of the above described embodiments, an outer sleeve may be used to assist the passage of the drilling tool into the substrate. An outer sleeve or shaft could surround the shaft 10 and be in threaded engagement therewith. The outer shaft could then be prevented from rotating while the shaft 10 rotates, this causing relative axial movement therebetween. This could be used to force the shaft 10 into a substrate and would be particularly useful where hard substrates were involved.

Figure 11:
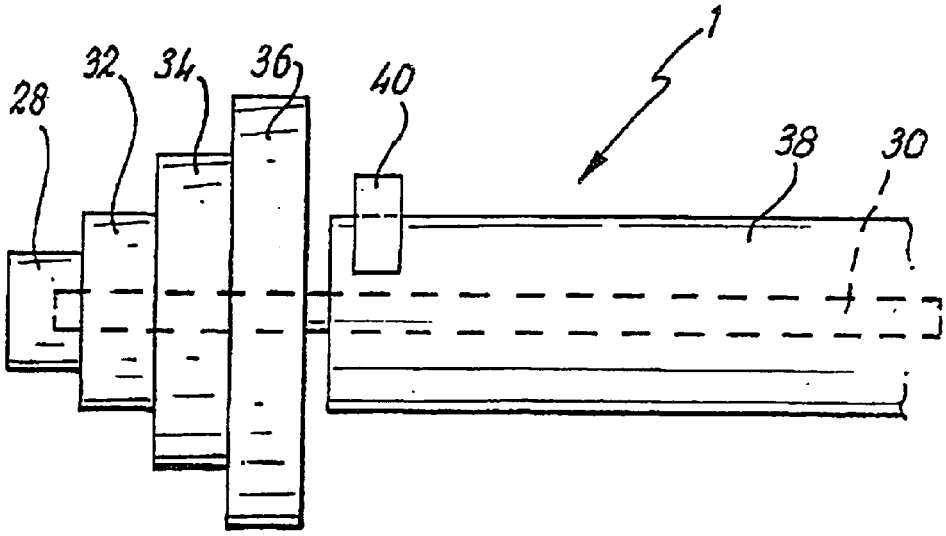
FIG. 11 is a partial schematic side view of a drilling tool in accordance with a fourth embodiment of the present invention.

FIG. 11 illustrates a further embodiment of the invention. A directional drilling apparatus in the form of a drilling tool 1 includes a pilot bore head in the form of a drilling head 28 mounted on a flexible, inner drive shaft 30. The drilling tool 1 further includes main bore heads in the form of drilling heads 32, 34 and 36.

Typically, the pilot drilling head 28 may be 15 mm in diameter, with a cross sectional area of about 180 $mm^2$. A second stage drilling head 32 may then be about 30 mm in diameter and the subsequent drilling heads of a larger diameter.

The drilling heads in this embodiment have flat faces and include diamonds set in resin welded to the faces in a desired pattern to optimise drilling performance.

An outer flexible drive shaft 38 surrounds and is co-axial with the inner drive shaft. Mounted on the outer flexible drive shaft 38 is a retractable steering cam 40, the function of which is described below.

Each of the drilling heads 28, 32, 34 and 36 may be selectively fitted to the inner drive shaft one at a time or together by use of pins, threaded connections, keyed collars, clamping a chuck or jaws. Such methods are known to the person skilled in the art and are not illustrated in FIG. 11.

In use, the pilot drilling head 28 is initially coupled to the inner drive shaft 30 and rotated in order to drill a small pilot bore. It is desirable initially to use a small diameter pilot drill because all drills have a "dead spot" in the centre whether the drill spins on itself and does not cut. With a pilot drill of small diameter, this dead spot is relatively small.

Once the pilot drill hole has been created, the further drilling heads may be coupled together or one at a time to the inner drive shaft 30 and used to drill the hole until it is of sufficient size.

The main drilling heads 32, 34 and 36 may then be removed before the next pilot hole is created. At this time, the cam 40 may be used to steer the drilling tool 1. Once the main drilling heads have been removed, the drilling tool 1 is located in a bore which has a diameter greater than that of the drilling tool. The retractable cam 40 may therefore be extended in order to push the drilling tool 1 in a chosen direction within the bore. The outer flexible drive shaft 30 may be rotated to a desired position, with the cam located opposite to the chosen direction of travel for the drilling tool 1. The cam 40 may then be extended, for example by a cam piston or pressure plate activated by air, gas, fluid, etc. This therefore pushes the drilling tool 1 towards a chosen side of the bore. The inner drive shaft may then be rotated to activate the pilot drill, with the cam still extended and in engagement with the inside of the bore hole. The cam therefore forces the pilot drill to create a bore hole which is located eccentrically relative to the axis of the previously drilled larger bore. The above described process may then be repeated, and the drilling tool 1 may thus be used to drill in any chosen direction.

In the above embodiment, the cam 40 may alternatively be operated with the main drilling heads in place. In this case, it produces a biasing force urging the drilling tool in a particular direction within the bore. In the above described embodiment in which the main drilling heads are selectively couplable to the inner drive shaft 30, the outer shaft may only rotate to move and actuate the cam 40. However, in an alternative embodiment, one or more of the main drilling heads 32, 34, 36 may be couplable to the outer drive shaft 38, which would then be rotated to effect the drilling operation.

Figure 12:
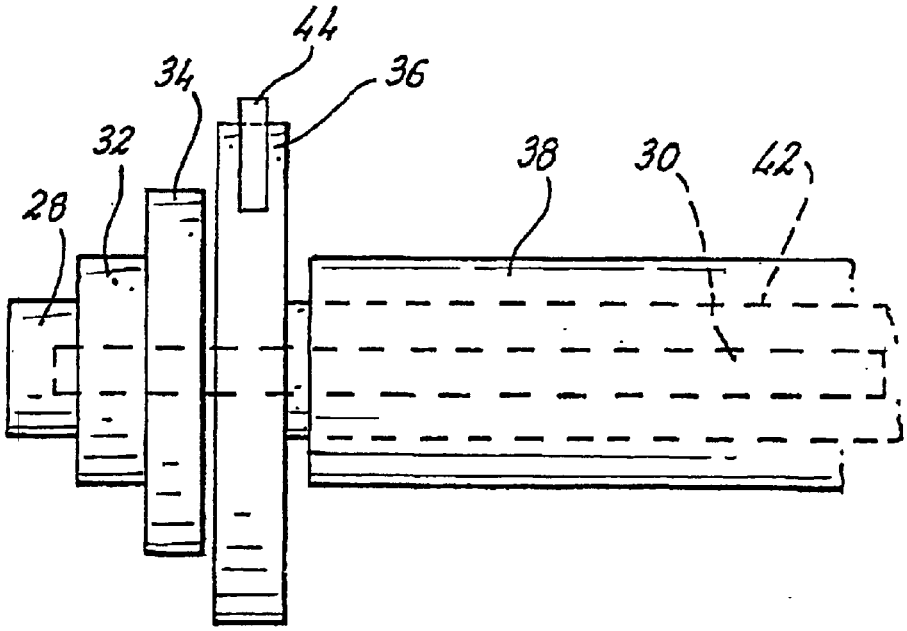
FIG. 12 is a partial schematic side view of a drilling tool in accordance with a fifth embodiment of the present invention.

FIG. 12 illustrates a drilling tool according to a further embodiment of the invention. In this embodiment, a pilot drilling head 28 and main drilling heads 32 and 34 are selectively couplable to an inner drive shaft 30. A large drilling head 36 is coupled to an intermediate drive shaft 42 located outwardly and co-axially with the inner drive shaft 30. An outer flexible drive shaft 38 surrounds the intermediate drive shaft 42.

In the above embodiment, a retractable steering cam 44 is mounted on the large drilling head 36. The cam may be activated or de-activated dependent on the direction of rotation of the intermediate drive shaft 42, as described above in relation to the embodiment of FIGS. 1 to 9. This embodiment operates generally similarly to the embodiment of FIG. 11 above except that the rotation of the large drilling head 36 is used to effect the changes in direction of the drilling tool 1.

Figure 13:
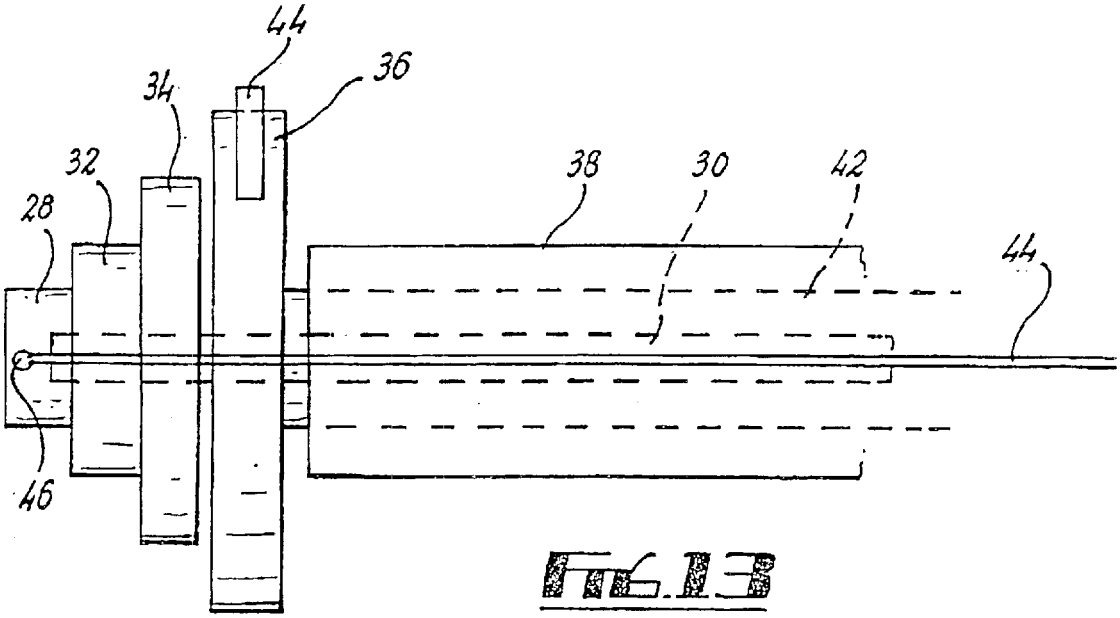
FIG. 13 is a partial schematic side view of a drilling tool in accordance with a sixth embodiment of the present invention.

FIG. 13 illustrates a further embodiment of the invention, which is generally similar to that of FIG. 12 except that a pipe 44 is provided for providing water to lubricate the drill head and remove debris. The pipe is located within the inner drive shaft 30, co-axial therewith, and conveys water to a water injection point 46 on the pilot drilling head 28.

The embodiments of FIGS. 14A and 14B again includes a pilot drilling head 28 mounted on an inner drive shaft 30 and a larger drilling head 32 mounted on an intermediate drive shaft 42. A steering plate 48 is coupled to an outer flexible drive shaft 38.

The steering plate 48 includes on each of two diametrically opposed sides a cam 50 which is normally biased by a spring 52 into a position (illustrated in FIG. 14A) where it does not project beyond the outer diameter of the drilling head 32. Referring to the detail in FIG. 14B, a tension cable 54, which extends down the axis of the drilling tool internally of the outer flexible drive shaft 38 may be pulled to overcome the bias of the spring 52 and force the cam into the position shown in FIG. 14B. In such position, the cam 50 forces the drilling tool 1 to move away from the side 56 of the drilled hole. The steering plate and cam may thus be used to control the direction of drilling.

The inner and intermediate drive shafts 30 and 42 may be in threaded engagement with the outer drive shaft 38. Thus, if the outer drive shaft is held in position, rotation of the pilot drilling head 28 or the drilling head 32 forces the drilling head forward relative to the outer flexible drive shaft 38 and thus assists in the forward movement of the drilling head.

Figure 14A:
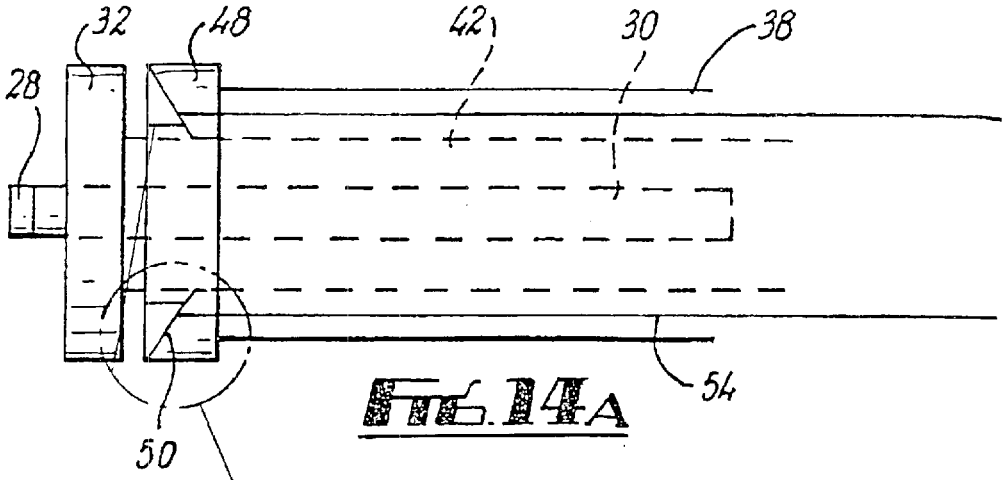
FIGS. 14A and 14B are a partial schematic side view and a detail thereof of a drilling tool in accordance with a seventh embodiment of the present invention.
Figure 14B:
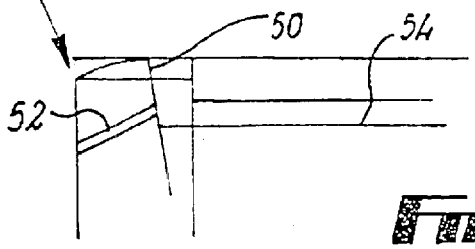
Figure 15A:
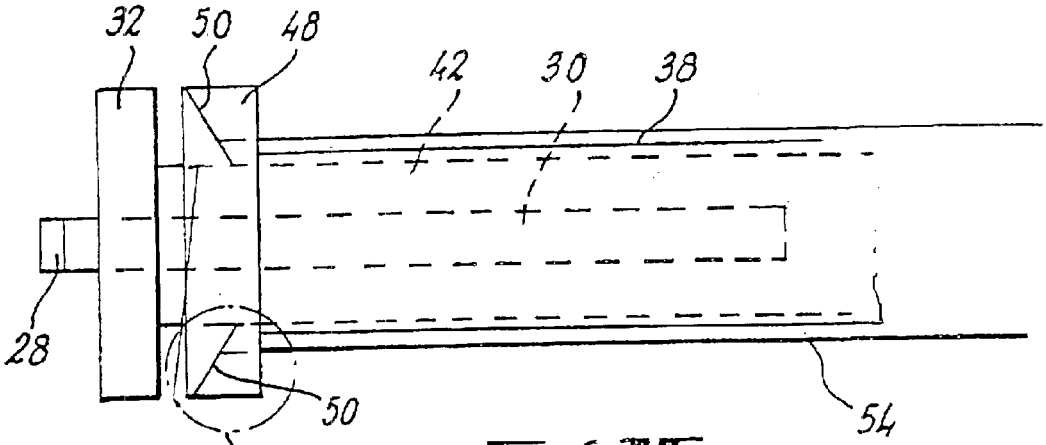
FIGS. 15A and 15B are a partial schematic side view and a detail thereof of a drilling tool in accordance with an eighth embodiment of the present invention.
Figure 15B:
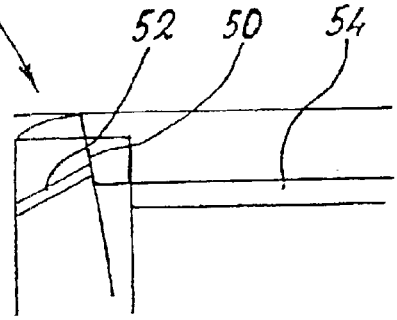

The embodiment of FIGS. 15A and 15B is generally similar to that of FIGS. 14A and 14B except that the tension cable 54 is located outside the outer flexible drive shaft 38.

Figure 16:
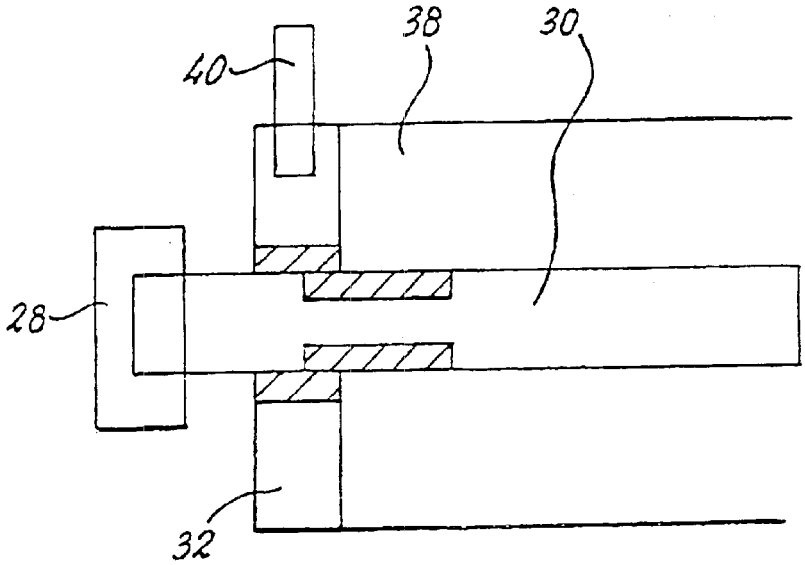
FIG. 16 is a partial schematic side view of a drilling tool in accordance with a ninth embodiment of the present invention.

The embodiment of FIG. 16 includes a pilot drilling head 28 mounted on an inner drive shaft 30 which is in threaded engagement with an outer drive shaft 38. A main drilling head 32 is mounted on the outer drive shaft. A cam 40 is mounted on the main drilling head 32 but is inactive when the main drilling head rotates in a drilling direction. In this embodiment, the pilot drilling head 28 may be used to drill a pilot bore, with the outer drive shaft held stationary and with the cam in engagement with an inner wall of the bore. The threaded engagement between the inner and outer drive shafts ensures that as the pilot drilling head is rotated it is pushed forward relative to the outer drive shaft and the main drilling head 32. Since the cam 40 engages the inner wall of the bore, this prevents backward movement of the outer drive shaft 38 and forces the pilot drilling head 28 forward.

In any of the above embodiments, vibration may be used to assist the drill head to move forward. The apparatus could include a non-cutting head functioning as an excavating device, for removal material to let the drilling heads move forward. Such a non-cutting head might contain a high pressure water jet, air, electricity, reciprocating needles, rotating members, etc.

Means for rotating the flexible drive shafts is provided at the non-drilling ends of the shafts. These means include a main drive motor which causes the shafts to rotate as desired and which also may push a chosen drive shaft through a tube which guides it to the structure to be drilled. This ensures that the shafts are contained and pass correctly into the drilled hole. The motor may also push the shaft forwards within the bore. A pump may also be provided to convey water or another lubricant to the drill heads and wires or tubes may be provided which are connected to the drill head to operate the steering mechanisms. The wires or tubes may be connected to levers on or near the drill head to exert additional pressure to push the drill head forward. This additional forward pressure is particularly useful as the drill head moves further away from the drilling rig.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. Apparatus for the directional drilling of a bore hole through a solid substrate, the apparatus including:

a main bore head mounted for rotation on a flexible main drive shaft; and elongate tensioning means extending axially along the flexible drive shaft substantially from the main bore head end of the drive shaft towards a driven end of the drive shaft, wherein tension in the tensioning means tends to urge the flexible drive shaft to bend, thereby altering the drilling direction.

2. Apparatus according to claim 1, wherein the elongate tensioning means is anchored at a position remote from the main bore head, extends towards the main bore head, passing freely through a locating means, and then extends towards the driven end of the drive shaft.

* * * * *